US007765751B2

(12) United States Patent
Vukovic et al.

(10) Patent No.: US 7,765,751 B2
(45) Date of Patent: Aug. 3, 2010

(54) WINDOW

(75) Inventors: Aleksander Vukovic, Grahovo (SI); Miha Klinar, Radovljica (SI)

(73) Assignee: Kovinoplastika Loz Industrija Kovinskih In Plasticnih Izdelkov D.D. (SI)

( * ) Notice: Subject to any disclaimer, the term of this patent is extended or adjusted under 35 U.S.C. 154(b) by 85 days.

(21) Appl. No.: 11/760,514

(22) Filed: Jun. 8, 2007

(65) Prior Publication Data

US 2008/0016801 A1 Jan. 24, 2008

(30) Foreign Application Priority Data

Jul. 20, 2006 (SI) ..... 200600171

(51) Int. Cl.
*E06B 7/00* (2006.01)
*E06B 3/00* (2006.01)

(52) U.S. Cl. ..... 52/204.595; 52/204.6; 52/204.1; 52/213; 52/210

(58) Field of Classification Search ..... 52/210–213, 52/204.62, 204.69, 204.7, 204.6, 204.595, 52/204.1, 204.5, 204.54, 204.591, 204.593, 52/204.597, 204.71
See application file for complete search history.

(56) References Cited

U.S. PATENT DOCUMENTS

| | | | | |
|---|---|---|---|---|
| 3,012,642 | A * | 12/1961 | Emmerich | 52/204.597 |
| 4,299,060 | A * | 11/1981 | Tippmann | 49/501 |
| 4,309,845 | A * | 1/1982 | Schmidt | 49/501 |
| 4,624,091 | A * | 11/1986 | Biro | 52/656.5 |
| 4,689,933 | A * | 9/1987 | Biro | 52/656.5 |
| 4,850,168 | A * | 7/1989 | Thorn | 52/207 |
| 2003/0185623 | A1 * | 10/2003 | Guillemet et al. | 403/374.1 |

FOREIGN PATENT DOCUMENTS

GB 2278142 A * 11/1994

* cited by examiner

*Primary Examiner*—Jeanette Chapman
(74) *Attorney, Agent, or Firm*—Andrus, Sceales, Starke & Sawall, LLP

(57) ABSTRACT

The present invention refers to a window consisting of a window frame and a window wing the latter comprising a frame and a glazing which bears a static load, and where at least one seal being arranged between said window frame and said window wing. The characteristic of the invention lies in that the glazing of the window wing is held by means of a spacer in the outer side area thereof there is each time arranged a suitably U-shaped groove in which there is inserted a glass-panel.

8 Claims, 1 Drawing Sheet

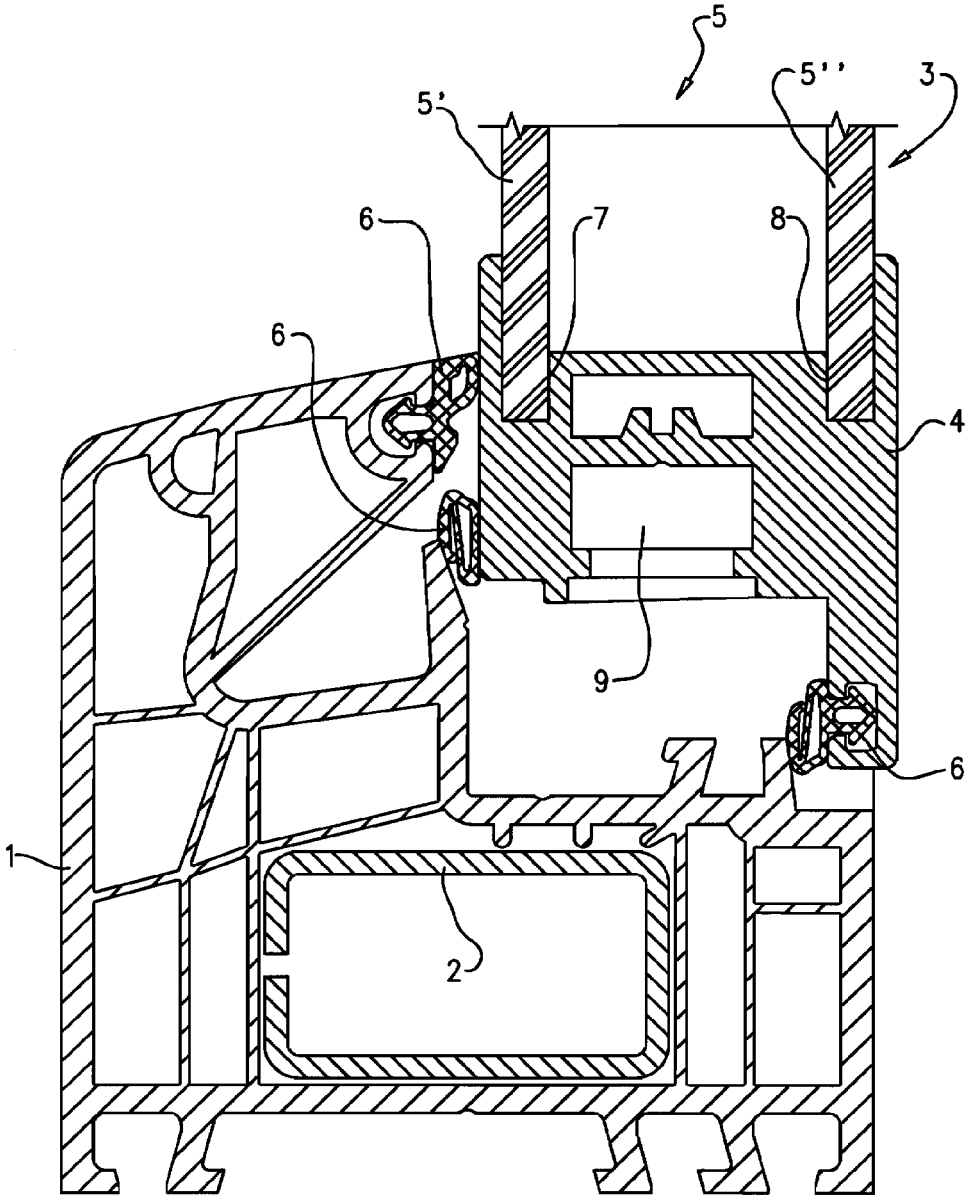
5
5''
3
5'
6
7
8
6
4
9
6
1
2

WINDOW

BACKGROUND

The present invention refers to a window consisting of a window frame and a window wing the latter comprising a frame and a glazing which bears a static load, and where at least one seal is arranged between said window frame and said window wing.

The window as mentioned above is well known. The said glazing is additionally reinforced by means of a frame of a window wing which is rather oversized in spite of the said frame comprises dimensions in a cross-sectional view that are approximately only half the dimensions of an ordinary frame of a window wing. In addition the glazing is to be associated with the said window frame, glued for instance, which represents an additional technological step in window production, thus the window of that kind is time and price consuming from the manufacturing point of view.

It is the object of the present invention to create a window of the aforementioned kind that will remedy the drawbacks of the known solutions.

SUMMARY

According to the invention the object as set above is solved by that a glazing of a window wing is held by means of a spacer where, in the outer side area thereof, there is in each case arranged a suitably formed groove. A glass-panel is placed in each case in the said groove thus creating the said glazing. Here, said spacer extends over the entire outside perimeter of the glazing.

It is further provided according to the invention that the spacer is formed on the side facing the window frame with a groove for inserting the window fittings. Said groove is preferably formed in a way that the known fittings of the existing windows can be used. The necessary stability of the window wing is achieved by means of the spacer on one hand and by means of the glazing on the other.

BRIEF DESCRIPTION OF THE DRAWING

Advantages of the present invention will become apparent upon the consideration of the drawing showing a partial cross-sectional view of a window frame and a window wing, and a description of the invention that follows.

DETAILED DESCRIPTION OF THE DRAWING

A window according to the invention consists of a window frame 1 either made of wood or formed as a hollow multi-chamber section of a plastic or metal. When said window frame 1 is formed of plastic then a reinforcing tube 2 is placed therein to increase the stability of the window frame 1. A window wing 3 cooperates with said window frame 1 consisting of a spacer 4 and a glazing 5 associated therewith, said glazing comprises, in the given case, two glass-panels 5', 5". A plurality of seals 6 known per se is arranged in certain parts between the window frame 1 and the window wing 3.

Said spacer 4 extends over the entire outside perimeter of the glazing 5 and is in the area of each outer edge thereof formed with suitable grooves, in the given case with grooves 7, 8 formed as a letter U for inserting each glass-panel 5', 5". Furthermore, said spacer 4 is formed in the side facing the window frame 1 with a groove 9 for inserting window fittings not shown, whereas it is provided for, according to the invention, that usual known fittings are used. The advantage of the window according to the invention is among other things that there is no need to manufacture special fittings for said window. Further, there is also no need for an inter-glazing spacer because that part is taken over by said new spacer 4 which is at the same time a guide for the window fittings. The necessary stability of the window wing is achieved by means of the spacer 4 on one hand and the glazing 5 on the other.

Said spacer 4 is preferably made of plastic and is associated with the glazing 5 by means of gluing, welding or similar method. Optionally, said spacer 4 can be manufactured of a metal, e.g. aluminium, stainless steel or similar.

The invention claimed is:

1. A window comprising:

an exterior window frame;

an interior window wing separably coupled to the window frame, wherein the window wing comprises a perimetrical spacer and a glazing that bears a static load, the glazing comprising a plurality of aligned glass panels having outer edges, and wherein the spacer has an inner face that surrounds and supports the outer edges of the plurality of aligned glass panels and an outer face that aligns with an interior surface of the window frame in the closed position and is separable from the window frame; and at least one seal configured to seal between the window frame and the outer face of the spacer when the window wing is in the closed position, wherein the inner face of the window wing defines a plurality of preformed U-shaped grooves, each U-shaped groove sized and shaped slightly larger than the edges of one of the glass panels so as to matingly receive and support an edge of said one glass panel, and wherein the outer face of the spacer defines a groove configured to receive installation of a window fitting.

2. The window according to claim 1, wherein the spacer extends over an entire outside perimeter of the glazing.

3. The window according to claim 1, wherein the window frame is made of wood.

4. The window according to claim 1, wherein the window frame is made of plastic.

5. The window according to claim 4, wherein the window frame comprises a reinforcing tube.

6. The window according to claim 1, wherein the glazing comprises two glass panels.

7. The window according to claim 1, wherein the spacer comprises metal.

8. The window according to claim 1, wherein the spacer comprises plastic.

* * * * *